US005810641A

United States Patent [19]

Lo

[11] Patent Number: 5,810,641

[45] Date of Patent: Sep. 22, 1998

[54] ROCKING MECHANISM WITH UPWARD, DOWNWARD, FORWARD AND BACKWARD ACTIONS

[76] Inventor: Szu Wei Lo, 7F-1, No. 3, Lane 173, Liu-Ho Road, Pu-Li Chen, Nan-Tou Hsien, Taiwan

[21] Appl. No.: 997,302

[22] Filed: Dec. 23, 1997

[51] Int. Cl.[6] ..... A63H 13/18; A63J 19/00; A63G 1/00; A63G 13/06

[52] U.S. Cl. ..... 446/325; 446/366; 472/29; 472/97

[58] Field of Search ..... 446/313, 314, 446/325, 326, 367, 396, 489; 472/29, 39, 95, 96, 97, 99; 40/411, 414

[56] References Cited

U.S. PATENT DOCUMENTS

| | | | |
|---|---|---|---|
| 2,334,290 | 11/1943 | Richter | 446/366 |
| 2,637,554 | 5/1953 | Terreson | 472/97 |
| 2,722,418 | 11/1955 | Small | 472/97 |
| 2,889,148 | 6/1959 | Lules | 472/97 |
| 3,710,506 | 1/1973 | Thornell | 446/314 X |
| 5,409,413 | 4/1995 | Hou | 446/325 |

FOREIGN PATENT DOCUMENTS

| | | | |
|---|---|---|---|
| 297682 | 5/1917 | Germany | 446/366 |
| 305749 | 5/1955 | Switzerland | 446/366 |

*Primary Examiner*—Robert A. Hafer
*Assistant Examiner*—D. Neal Muir
*Attorney, Agent, or Firm*—Rosenberg, Klein & Bilker

[57] ABSTRACT

A rocking mechanism with upward, downward, forward and backward actions is disclosed. It mainly includes a base, a driving unit, a rocking unit, an outer pipe unit, an inner pipe unit, a rocking block, a upper sleeve and a decoration. With matching the inclined guiding slots on the rocking block and the fixed key of the outer pipe unit, the driving block can rock forward and backward when moving upward and downward in the same time. The effect of the rock makes the decoration of the mechanism lively as a horse runs.

2 Claims, 5 Drawing Sheets

ROCKING MECHANISM WITH UPWARD, DOWNWARD, FORWARD AND BACKWARD ACTIONS

BACKGROUND OF THE INVENTION

The present invention relates to a rocking mechanism with upward, downward forward and backward actions.

FIELD OF TECHNOLOGY

Please refer to FIG. 1. The conventional decoration includes a base 11 with a motor and a driving gear set, a rod 12 and a decorative substance 13 like a horse. Because the rod 12 only can rotate or move upward and downward, the said decoration acts simply and looks dull. Therefore, the makers wish to develop a decoration with more visual effect for entertainment.

PURPOSE AND FUNCTION

The purpose of the invention is to solve the said problem and offer a decoration that can move upward and downward, and also rock forward and backward meantime.

The second purpose of the invention is to offer a mechanism to simulate a ride on a wild horse.

DETAILED DESCRIPTION OF THE PREFERRED EMBODIMENT

Figure 1:
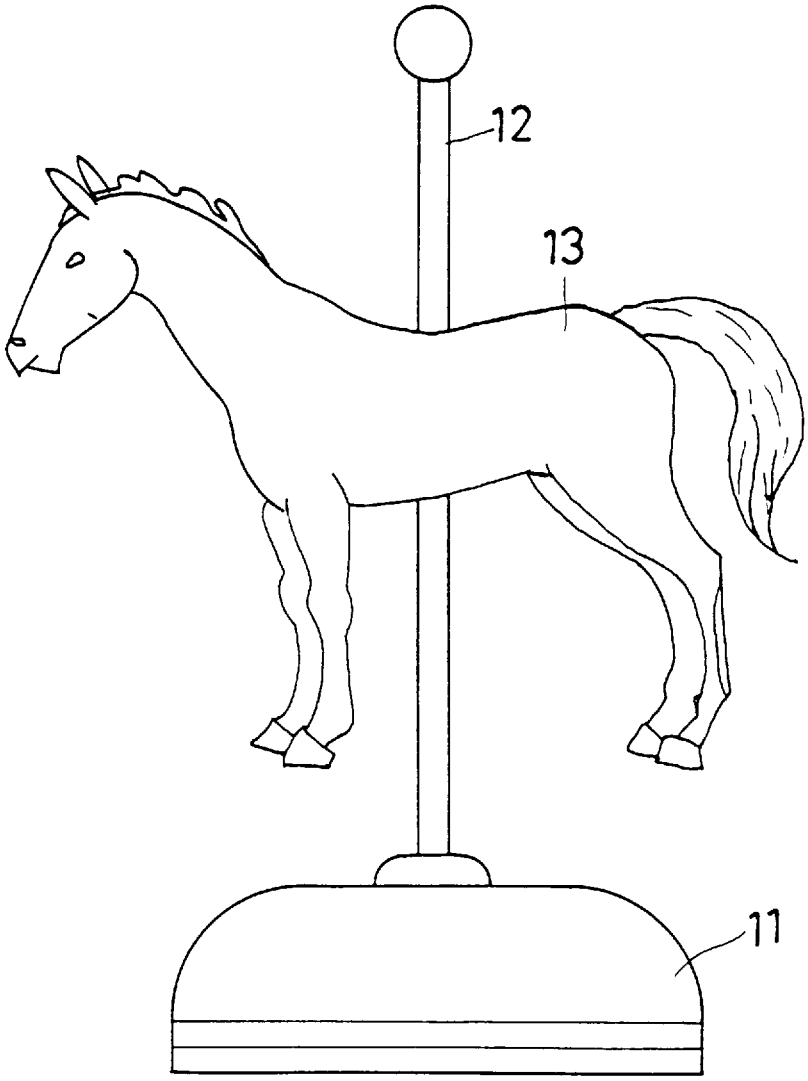
FIG. 1 PRIOR ART
FIG. 1 is a perspective view showing a prior art
Figure 2:
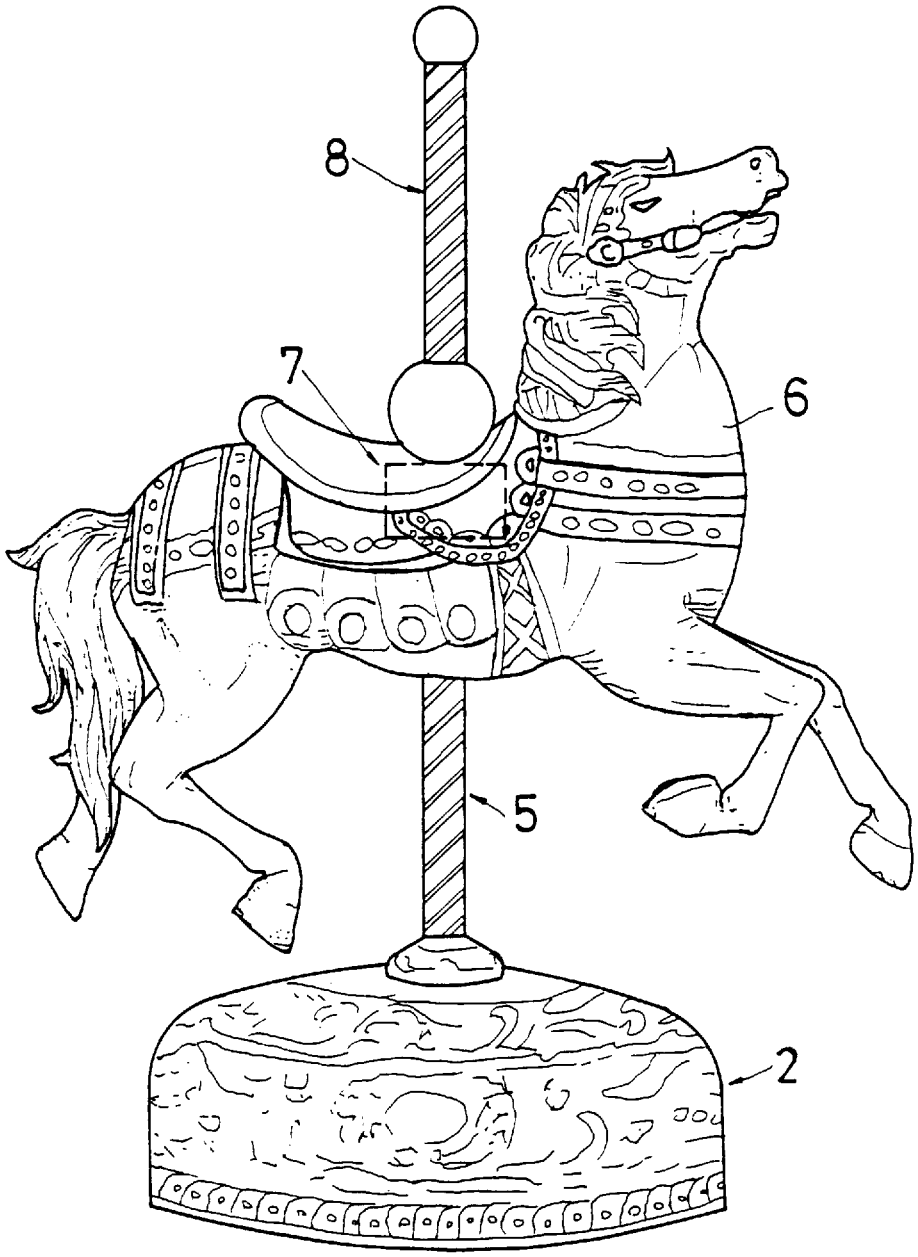
FIG. 2 is a perspective view of the present invention
Figures 3, 4:
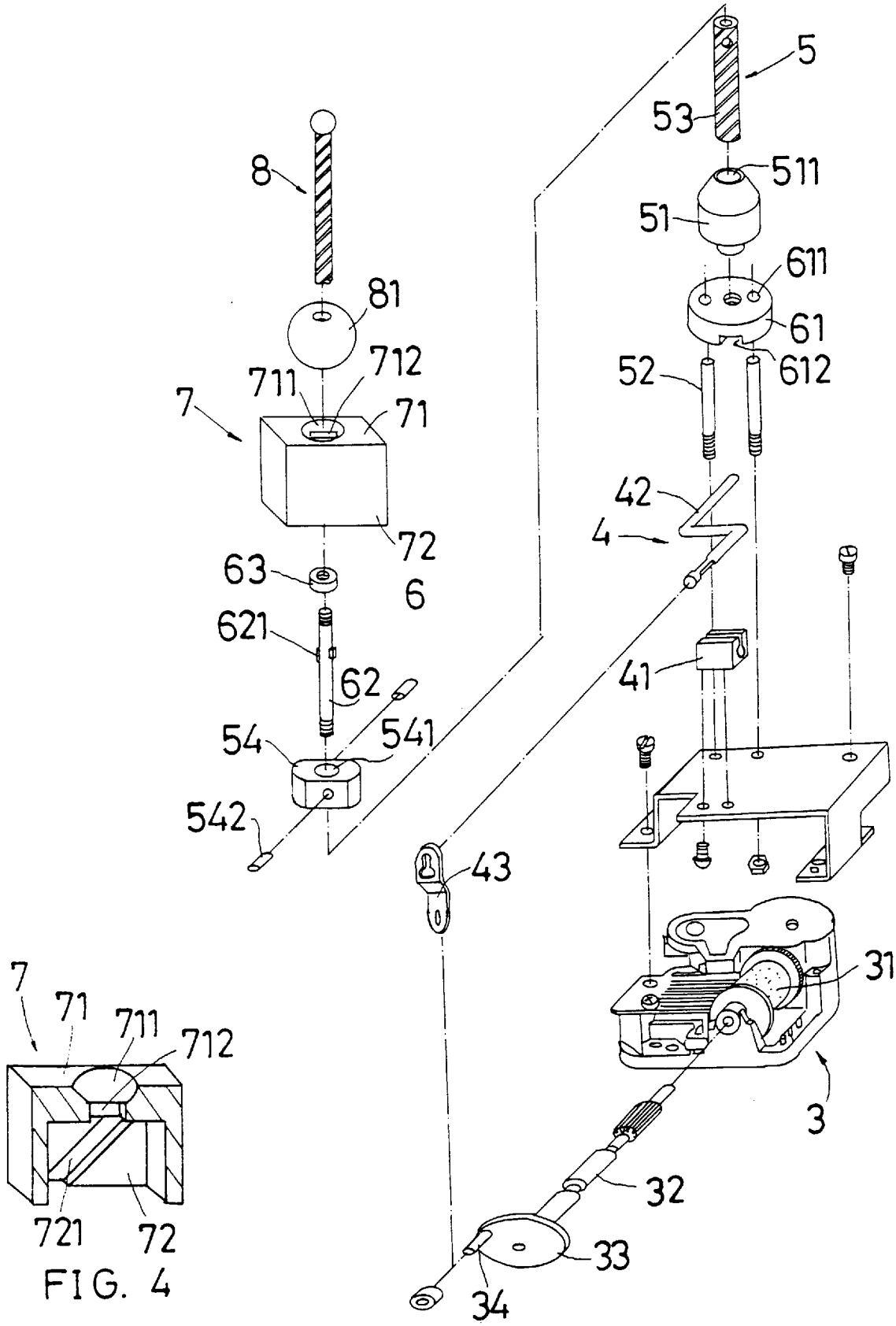
FIG. 3 is an exploding view of the present invention
FIG. 4 is a sectional view taken along the IV—IV line in FIG. 3
Figure 5:
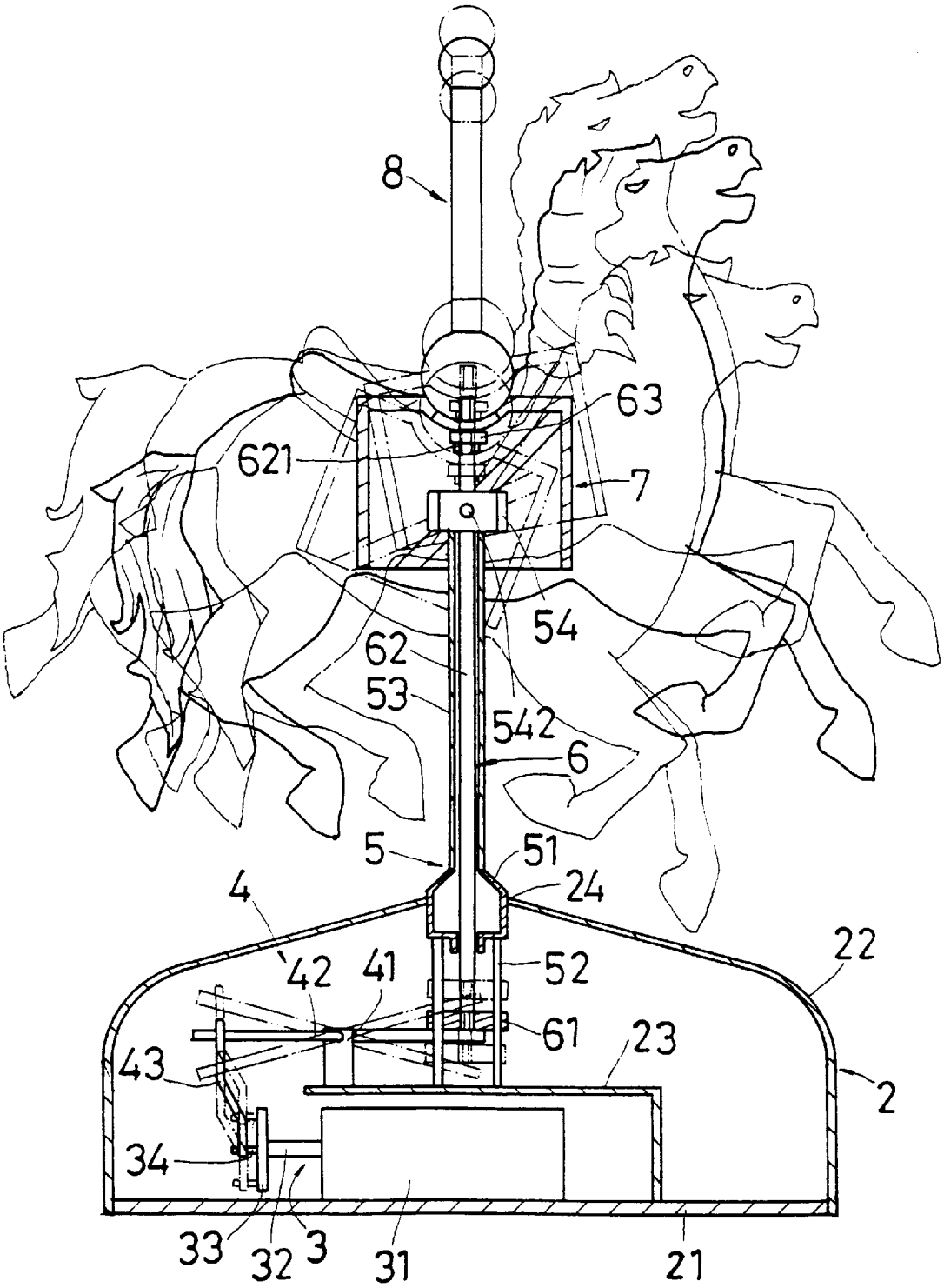
FIG. 5 is an assembled sectional view of the present invention

Refer to FIG. 2 to 6, the invention mainly includes the following parts: a base 2, a driving unit 3, a rocking unit 4, outer pie unit 5, inner rod unit 6, rocking block 7*m* upper sleeve 8 and a decoration 9.

The base 2 consists of a base plate 21, a shell 22 with a central hole 24 on the top, a flat plate 23 between the base plate 21 and the shell 22.

The driving unit 3 consists of a driving motor 31, a spin shift 32 to output the power of the motor, a spin plate 33 set at the end of the spin shift 32 and a eccentric crank 34 disposed at the planned eccentric position of the spin plate 33.

The rocking unit 4 consists of a support 41, a rocking rod 42 and a connecting link 43. The rocking rod 42 is set in the support 41 disposed on the flat plate 23. The end of the rocking rod 42 connects with the end of connecting link 43 whose the other end connects with the eccentric crank 34.

The outer pipe unit 5 consists of a bottom anchor socket 51, two struts 52, an outer sleeve 53 and an upper anchor socket 54. The bottom anchor socket 51 is disposed on the central hole 24 is fixed on the flat plate 23 by the two struts 52. The upper anchor socket 54 is disposed on the top of the vertical outer sleeve 53 whose bottom is fixed on the bottom anchor socket 51, and extends out a pair of fixed keys 542 horizontally form its side to match the upper and bottom holes on the upper and bottom anchor socket 54, 51.

The inner rod unit consists of a sliding base 61, an inner rod 62 and a stop ring 63. The sliding base 61 has two holes 611 which can make it slide along the two struts 52 and a dent 612 on its bottom to put the end of the rocking rod 42. The bottom of the inner rod 62 is fixed on the sliding base 61, and the top of the inner rod 62 extends a pair of small keys 621 to lock the stop ring 63. The inner rod 62 can also move upward and downward in the outer sleeve 53 when piercing through the upper and bottom hole 541, 511.

The rocking block 7 consists of a top plate 71 and two side plates 72, being parallel to each other, extended downward from the top plate 71. The top plate 71 has a spherical recess 711 with a long guiding hole 712 whose width is more than the diameter of the inner rod 62 and less than the outer diameter of the stop ring 63. The side plate 72 has a pair of inclined guiding slots 721 which can touch and guide the fixed key 542 on the upper anchor socket 54.

The upper sleeve 8 is fixed on the top of the inner rod 62 and has a spherical part 81 at its bottom.

The decoration 9 is disposed on the rocking block 7.

Figure 6:
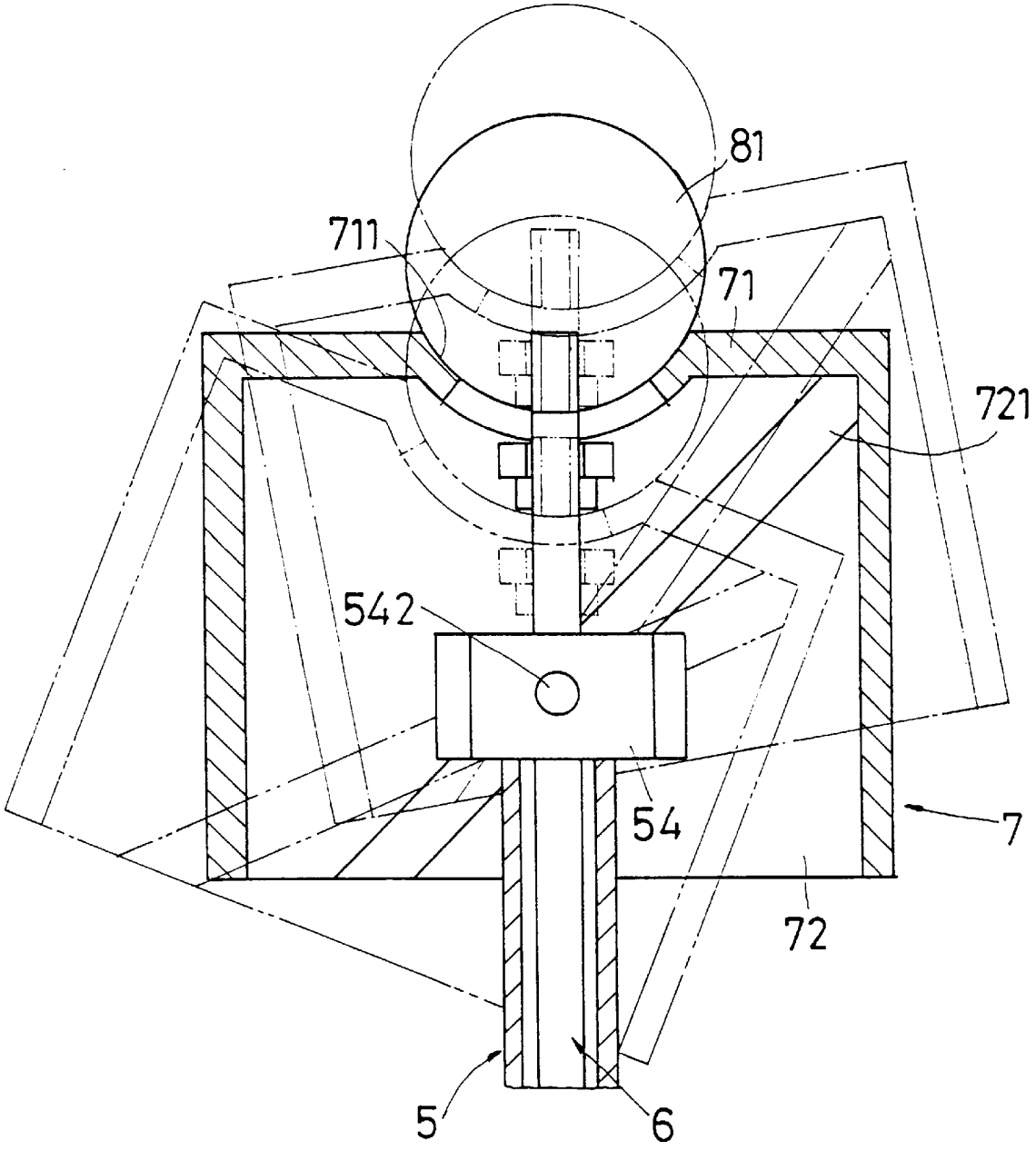
FIG. 6 is an enlarged view for the assembled present invention

With the composition of these parts, when the driving motor 31 is started, the spin shaft 31 rotates and drives the spin plate 33 and the eccentric crank 34. The rocking rod driven by the connecting link 43 and the inner rod unit 6 (including the sliding base 61, the inner rod 62 and the stop ring 63) move upward and downward. Due to the stop ring 63 at the top of the inner rod 62 making the driving block 7 move upward and downward and the inclined guiding slots 721 of the driving block 7 contacting with the fixed keys 542 of the upper anchor socket 54 inside, the driving block 7 can rock forward and backward when moving upward and downward in the same time as shown in FIG. 6. Therefore, the decoration 9 would do the same actions.

Of course, many cases developed from the invention can be done by just changing the detail. For example, the driving motor driven by the power generated from battery in the said case can be also driven by connecting to a power supply.

Furthermore, the decoration 9 can be replaced by another animal like running deer.

The said examples are only for describing the invention, not to limit the field of the invention. So, in every case of changing dimension of the parts or replacing the components is all in the field of this invention.

The said examples are only for describing the details of the invention, in every case of simple change for the example is all in the field of this invention.

I claim:

1. A rocking mechanism with upward, downward, forward and backward actions comprising:

(a) a base, said base consisting of a base plate, a shell with a central hole on its top, a flat plate between the base plate and the shell;

(b) a driving unit, said driving unit consisting of a driving motor, a spin shaft to output the power of the motor, a spin plate set at one end of the spin shaft and an eccentric crank disposed at a predetermined eccentric position of the spin plate;

(c) a rocking unit, said rocking unit consisting of a support, a rocking rod and a connecting link, said support being disposed on a flat plane, said rocking rod being disposed on the support, one end of the rocking rod connecting with one end of the connecting link whereas the other end of the connecting link connects with the eccentric crank;

(d) an outer pipe unit, the outer pipe unit consisting of a bottom anchor socket, two struts, an outer sleeve and an upper anchor socket, the bottom anchor socket being disposed on the central hole and fixed on the flat plate by these two struts, the upper anchor socket being disposed on the top of the vertical outer sleeve whose bottom being fixed on the bottom anchor socket, and a pair of fixed keys horizontally extending from the upper anchor socket, the upper and bottom anchor socket having an upper hole and a bottom holes respectively;

(e) an inner rod unit, the inner rod unit consisting of a sliding base, an inner rod and a stop ring, the sliding base having two holes which can make it slide along the two struts and a dent on its bottom to receive the end of the rocking rod, a bottom of the inner rod being fixed on the sliding base, and a top of the inner rod extending a small key to lock the stop ring so that the inner rod can move upward and downward in the outer sleeve when piercing through the upper and bottom holes;

(f) a rocking block, the rocking block consisting of a top plate and two parallel side plates which are extended downward from the top plate, the top plate having a spherical recess with a long guiding hole whose width is more than the diameter of the inner rod and less than the outer diameter of the stop ring, the side plate has a pair of inclined guiding slots which can touch and guide the fixed keys on the upper anchor socket;

(g) an upper sleeve, the upper sleeve being fixed on the top of the inner rod and having a spherical part at its bottom;

(h) a decoration, the decoration being disposed on the rocking block;

whereby, when the driving motor is started, the spin shaft rotates and drives the spin plate and the eccentric crank, the rocking rod driven by the connecting link and the inner rod unit move upward and downward, due to the stop ring at the top of the inner rod making the driving block move upward and downward and the inclined guiding slots of the driving block contacting with the fixed keys of the upper anchor socket inside, the driving block can rock forward and backward when moving upward and downward in the same time.

2. According to the mechanism with rocking actions as claimed in claim 1, the decoration of the mechanism is a running horse.

* * * * *